US007769309B2

(12) United States Patent
Tomita et al.

(10) Patent No.: US 7,769,309 B2
(45) Date of Patent: Aug. 3, 2010

(54) IMAGE FORMING APPARATUS AND METHOD WITH PROCESS CONTROL FOR STABLY FORMING IMAGES

(75) Inventors: Shoji Tomita, Yao (JP); Toru Yosioka, Nara (JP); Shuhichi Morikuni, Nara (JP); Tsutomu Nagata, Kyotanabe (JP); Takashi Hirota, Yamatokoriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 258 days.

(21) Appl. No.: 11/873,551

(22) Filed: Oct. 17, 2007

(65) Prior Publication Data

US 2008/0175611 A1 Jul. 24, 2008

(30) Foreign Application Priority Data

Oct. 18, 2006 (JP) ..... P2006-284362

(51) Int. Cl.
*G03G 15/00* (2006.01)

(52) U.S. Cl. ..... 399/49; 399/74

(58) Field of Classification Search ..... 399/9, 399/49, 53, 60, 74
See application file for complete search history.

(56) References Cited

U.S. PATENT DOCUMENTS 4,657,377 A * 4/1987 Takahashi ..... 399/74 X
4,801,980 A * 1/1989 Arai et al. ..... 399/74 X
5,053,822 A * 10/1991 Butler ..... 399/74
6,070,022 A * 5/2000 Kobayashi et al. ..... 399/49 X
6,898,381 B2 * 5/2005 Maebashi et al. ..... 399/49 X
7,215,896 B2 * 5/2007 Yamada et al. ..... 399/49

FOREIGN PATENT DOCUMENTS

| | | | |
|---|---|---|---|
| JP | 2-253281 | A | 10/1990 |
| JP | 5-257357 | A | 10/1993 |
| JP | 6-301257 | A | 10/1994 |
| JP | 60-97368 | A | 5/1995 |
| JP | 7-281439 | A | 10/1995 |
| JP | 7-281493 | A | 10/1995 |
| JP | 2006-110913 | A | 4/2006 |

* cited by examiner

*Primary Examiner*—Sandra L Brase
(74) *Attorney, Agent, or Firm*—Nixon & Vanderhye P.C.

(57) ABSTRACT

An image forming apparatus is provided having a mechanism that toner density of a toner image is automatically adjusted based on a toner patch. In an image forming apparatus including a document conveying section, a document reading section, an image forming section, a sheet discharging section, a sheet feeding section, a patch density detecting section, and a toner density adjusting section for adjusting density of a toner image depending on a result detected by the patch density detecting section, there are further provided a patch forming section for forming a toner patch, an operation detecting section for detecting an operating state of the patch density detecting section, and a patch printing section for printing the toner patch in response to such a result detected by the operation detecting section that the patch density detecting section does not properly operate, thereby adjusting the toner density based on the patch image.

13 Claims, 6 Drawing Sheets

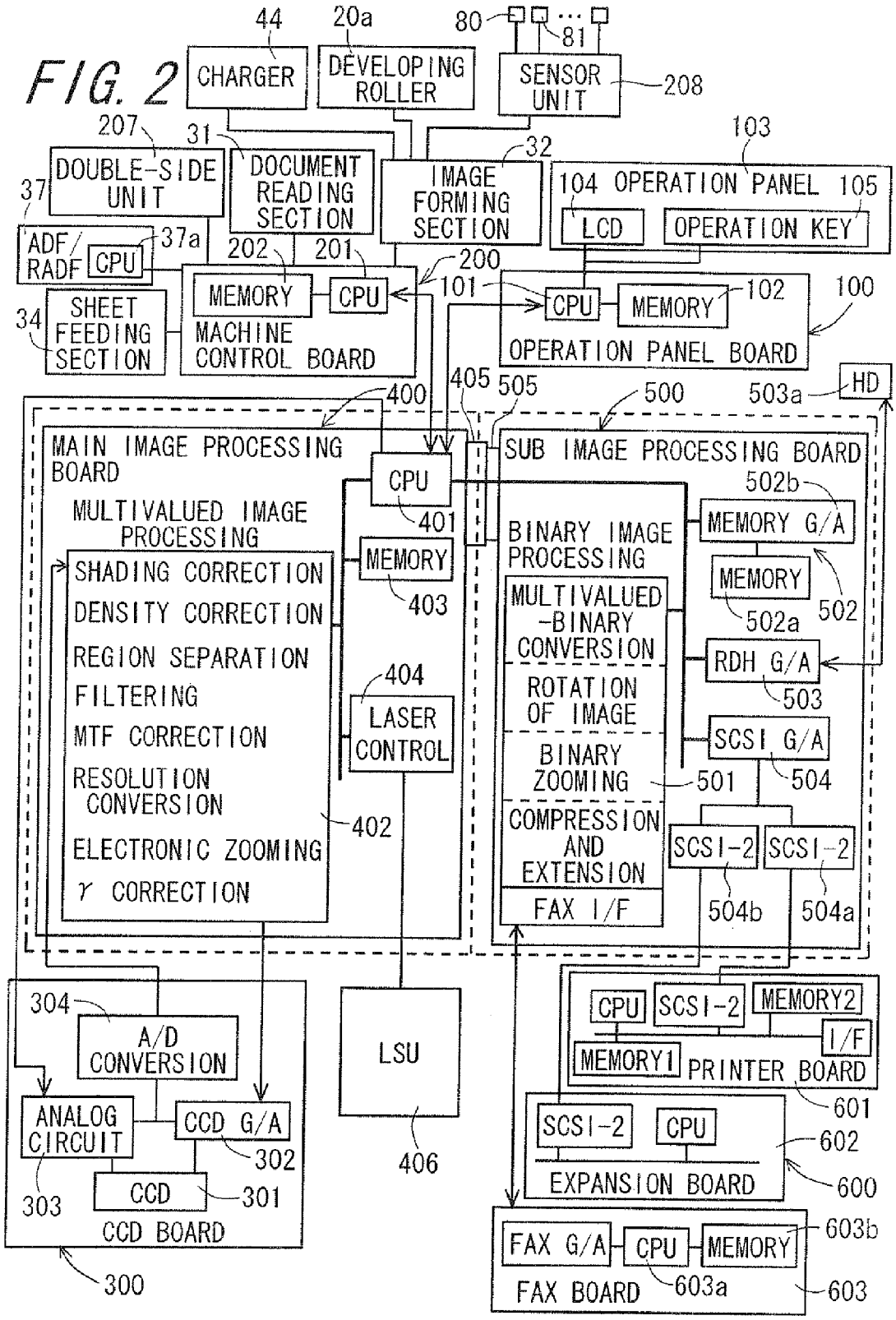
FIG. 2
CHARGER
DEVELOPING ROLLER
SENSOR UNIT
DOUBLE-SIDE UNIT
DOCUMENT READING SECTION
IMAGE FORMING SECTION
OPERATION PANEL
LCD
OPERATION KEY
ADF/RADF
CPU
MEMORY
CPU
SHEET FEEDING SECTION
MACHINE CONTROL BOARD
CPU
MEMORY
OPERATION PANEL BOARD
HD
MAIN IMAGE PROCESSING BOARD
CPU
MULTIVALUED IMAGE PROCESSING
SHADING CORRECTION
DENSITY CORRECTION
REGION SEPARATION
FILTERING
MTF CORRECTION
RESOLUTION CONVERSION
ELECTRONIC ZOOMING
γ CORRECTION
MEMORY
LASER CONTROL
SUB IMAGE PROCESSING BOARD
BINARY IMAGE PROCESSING
MULTIVALUED -BINARY CONVERSION
ROTATION OF IMAGE
BINARY ZOOMING
COMPRESSION AND EXTENSION
FAX I/F
MEMORY G/A
MEMORY
RDH G/A
SCSI G/A
SCSI-2
SCSI-2
A/D CONVERSION
ANALOG CIRCUIT
CCD G/A
CCD
CCD BOARD
LSU
CPU
SCSI-2
MEMORY2
I/F
MEMORY1
PRINTER BOARD
SCSI-2
CPU
EXPANSION BOARD
FAX G/A
CPU
MEMORY
FAX BOARD

COPY MODE PATCH

PRINTER MODE PATCH

FIG. 5A
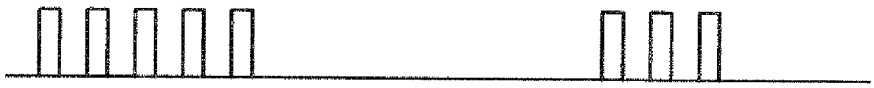
FIG. 5B
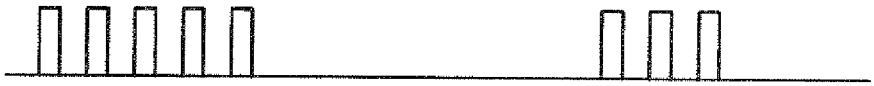
FIG. 5C
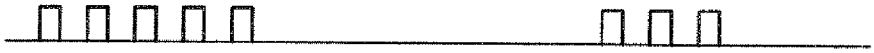
FIG. 5D

IMAGE FORMING APPARATUS AND METHOD WITH PROCESS CONTROL FOR STABLY FORMING IMAGES

CROSS-REFERENCE TO RELATED APPLICATION

This application claims priority to Japanese Patent Application No. 2006-284362, which was filed on Oct. 18, 2006, the contents of which are incorporated herein by reference in its entirety.

BACKGROUND OF THE INVENTION

1. Field of the Invention

The present invention relates to an image forming apparatus.

2. Description of the Related Art

An image forming apparatus employing an electrophotographic system (hereinafter referred to simply as "an image forming apparatus") has been widely used in various fields today on account of its advantage that a high-quality image can be printed on a recording medium through simple operations. The image forming apparatus includes, for example, a photoreceptor drum, a charging section, an exposing section, a developing section, a transferring section, and a fixing section. The photoreceptor drum has a photosensitive layer by which a surface of the photoreceptor drum is formed. The charging section charges the surface of the photoreceptor drum until the surface has predetermined polarity and potential. The exposing section forms an electrostatic latent image on the charged surface of the photoreceptor drum. The developing section supplies a toner to the electrostatic latent image on the surface of the photoreceptor drum so that a toner image is formed. The transferring section transfers the toner image on the surface of the photoreceptor drum onto the recording medium. The fixing section fixes the toner image to the recording medium. By way of processes in these respective sections, an image in accordance with image information is formed on the recording medium.

In the image forming apparatus, control on toner density of the toner image, called a process control, is carried out in order to maintain image quality of the image at high level. A change in the amount of toner electrostatic charge easily occurs over time by influences such as humidity, temperature, and heat developed inside the image forming apparatus. Accordingly, the toner density of the toner image cannot be constant even when the potential of the charged surface of the photoreceptor drum, potential upon exposure for forming the electrostatic image, development bias voltage applied to a developing device, and the like element are respectively set at constant levels. A control for bringing the toner density back to the reference toner density which is established upon designing the image forming apparatus, is called the process control. In the process control, first of all, the development bias voltage is continuously changed, for example, so that a plurality of toner patches (toner images) which are sequentially different in toner density are formed on the surface of the photoreceptor drum. The toner density of each of these toner patches is detected by a toner density detecting section, and a result thus detected is inputted to a control section disposed in the image forming apparatus. In the control section, the detected result is compared with the reference toner density which has been inputted in advance so that one toner patch is selected whose toner density is the closest to the reference toner density, and a value of the development bias voltage applied in forming the toner patch is specified. On the basis of the specified value of the development bias voltage, a toner image is formed on the surface of the photoreceptor drum, thus allowing stable formation of a toner image whose density is almost equal to the reference toner density. In addition, in the process control, the toner density can be also adjusted by changing voltage in charging the photoreceptor drum, potential in exposing the photoreceptor drum, etc.

As described above, the process control is very important for stabilizing the toner density and thus the image density. In the process control, a photoelectric sensor having a light-emitting element and a light-receiving element is mainly used as the toner density detecting section. The light-emitting element emits light to the toner patch. The light-receiving element detects a reflection light amount of light emitted from the light-emitting element to the toner patch, and converts the amount to an electric signal which is then delivered to the control section of the image forming apparatus. The photoelectric sensor detects the toner density almost precisely, therefore being useful. The photoelectric sensor, however, relatively often suffers from malfunctions which may cause difficulty in performing the process control. In the image forming apparatus which adopts the process control, the image forming operation is, in many cases, brought to a halt when the toner density detecting sections such as the photoelectric sensor goes down. In such a case, it is necessary to refrain from using the image forming apparatus until the maintenance check is conducted. Along with more and more demands for enhancement in performance of the image forming apparatus, there has been a demand for an image forming apparatus which is capable of continuing the image forming operation even with the toner density detecting sensor broken and thus forming an image whose quality is substantially equal to that obtained while the toner density detecting sensor properly operates. In response to the above demand, there have been various proposals.

For example, there has been proposed an image forming apparatus which includes a patch density detecting section, a voltage difference detecting section, a reference value determining section, an adjustment value determining section, a memory updating section, an output value readout section, and an average value calculating section (refer to Japanese Unexamined Patent Publication JP-A 6-301257 (1994)). In the image forming apparatus of Japanese Unexamined Patent Publication JP-A 6-301257 (1994), a photoelectric sensor is used for the patch density detecting section. The voltage difference detecting section determines a difference (hereinafter referred to as "a voltage difference") between a voltage value corresponding to light intensity measured by the toner density detecting section and a voltage value inputted last time. The reference value determining section determines whether or not the voltage difference obtained by the voltage difference detecting section falls in a range of reference value. The adjustment value determining section determines an output adjustment value based on such a determined result given by the reference value determining section that the voltage difference falls in the range of reference value. The memory updating section stores the latest output adjustment value to be inputted to the patch density detecting section, and the output adjustment value. The output value readout section reads out respective output adjustment values which have been obtained past for multiple occasions, based on such a determined result that the voltage difference given by the reference value determining section is out of the range of reference value. The average value calculating section determines an average value of the respective output adjustment values for multiple occasions read out by the output value readout section. In the image forming apparatus of JP-A 6-301257 (1994), when the patch density detecting section 80 properly works, the control is carried out based on the output adjustment value which is determined by the adjustment value determining section. On the other hand, when the patch density detecting section malfunctions and thus outputs an abnormal value that could not be taken under normal conditions, the control is carried out based on the output adjustment value determined by the average value calculating section. The image forming apparatus of JP-A 6-301257 (1994) in which the control is carried out based on the voltage difference, however fails to carry out a proper control in the case where the voltage value outputted by the patch density detecting section gradually changes, since the malfunction of the patch density detecting section is not sufficiently reflected to the adjustment value.

SUMMARY OF THE INVENTION

An object of the invention is to provide an image forming apparatus having a mechanism that toner density of a toner image is automatically adjusted based on a toner patch, which image forming apparatus can form a toner image having a toner density substantially equal to a design value without a halt of an image forming operation even when a toner density detecting section malfunctions and which thus allows stable formation of images having substantially the same image density.

An embodiment of the invention provides an image forming apparatus comprising:

an image forming section having at least an image bearing member on which surface an electrostatic latent image is formed, the image forming section being used for printing an image by supplying a toner to the electrostatic latent image on the image bearing member to form a toner image and transferring and fixing the toner image onto a recording medium;

a patch forming section for controlling the image forming section so as to form on the image bearing member a plurality of toner patches whose toner densities are different from each other in sequence, by changing the toner patches forming conditions;

a patch density detecting section for detecting patch densities which are the toner densities of the plurality of the toner patches formed on the image bearing member;

a toner density adjusting section for adjusting density of the toner image formed by the image forming section, depending on a result detected by the patch density detecting section;

an operation detecting section for detecting whether or not the patch density detecting section operates properly; and a patch printing section for controlling the image forming section, when a result detected by the operation detecting section is such that the patch density detecting section does not properly operate, so as to form a plurality of patch images by printing on a recording medium the plurality of the toner patches which are formed on the image bearing member and different in density from each other in sequence.

According to an embodiment of the invention, an electrophotographic image forming apparatus is provided including an image forming section, a patch forming section, a patch density detecting section, a toner density adjusting section, an operation detecting section; and a patch-printing section. The image forming section develops an electrostatic latent image on an image bearing member with use of a toner so that a toner image is formed, and transfers and fixes the toner image onto a recording medium, thus printing an image. The patch forming section controls the image forming section so as to form on the image bearing member a plurality of toner patches whose toner densities are different from each other in sequence by eight stages, for example. The patch density detecting section detects toner densities of a plurality of the toner patches. Depending on a result detected by the patch density detecting section, the toner density adjusting section adjusts toner density of the toner image which is formed by the toner image forming section. The operation detecting section detects whether or not the patch density detecting section operates properly. When a result detected by the operation detecting section is such that the patch density detecting section does not properly operate, the patch printing section controls the image forming section so that a plurality of the toner patches which have been formed on the image bearing member are printed on the recording medium to form patch images.

In the image forming apparatus of the invention, embodiment, when the patch density detecting section operates properly, the patch forming section, the patch density detecting section, and the toner density adjusting section are used to form an image whose image density falls in a proper range, that is, in a range of a set value. When the patch density detecting section does not properly operate, the patch forming section and the patch printing section are used to print the plurality of the toner patches on the recording medium to form the patch images. In the image forming apparatus of the invention embodiment, a patch image having proper image density which is the closest to a set value of image density is selected from the printed patch images, and under forming conditions (including transfer bias voltage value, charging voltage value for a photoreceptor drum, and exposure voltage value given by an exposing section) of the toner patch which is the original of the selected patch image, an image forming operation can be carried out. Accordingly, even when the toner density detecting section malfunctions, there is no need to stop the image forming operation until next maintenance check, thus allowing stable formation of images having proper image density.

Further, in an embodiment the invention, it is preferable that the image forming apparatus further comprises:

a mark imparting section for controlling the patch printing section, when a result detected by the operation detecting section is such that the patch density detecting section does not properly operate, so as to impart different marks to patch images corresponding to the plurality of the toner patches formed by the patch forming section;

a first memory section for writing therein forming conditions of the plurality of the toner patches formed by the patch forming section, so as to correspond to the marks imparted by the mark imparting section to the patch images;

a display section for selectively displaying marks corresponding to the marks imparted by the mark imparting section to the patch images; and a first condition setting section for reading out from the memory section the forming conditions corresponding to the mark selected by the display section, and setting the forming conditions as toner image forming conditions.

According to the invention embodiment, it is preferred that the image forming apparatus further includes a mark imparting section, a first memory section, a display section, and a first condition setting section. The mark imparting section controls the patch printing section so that different marks are imparted to patch images corresponding to the plurality of the toner patches formed by the patch forming section. Into the first memory section, forming conditions of the plurality of the toner patches are written so as to correspond to the marks imparted by the mark imparting section to the patch images. The display section selectively displays marks corresponding to the marks imparted by the mark imparting section to the patch images. The first condition setting section reads out from the memory section the forming conditions corresponding to the mark selected by the display section, and then sets the forming conditions as toner image forming conditions. Thanks to the configuration as described above, the image forming operation which is temporarily suspended due to the malfunction of the patch density detecting section, can restart almost automatically and moreover, a length of time from the detection of malfunction to the restart of image forming operation can be very short.

Further, in another embodiment of the invention, it is preferable that the image forming apparatus further comprises:

an image density detecting section for detecting image densities of the plurality of the patch images which are printed on the recording medium by the patch printing section;

an image density determining section for determining a patch image having proper image density, depending on a result detected by the image density detecting section;

a second memory section for writing therein forming conditions of the plurality of the toner patches formed by the patch forming section; and a second condition setting section for reading out from the memory section the forming conditions of the toner patch of the patch image having the proper image density, depending on the result detected by the image density determining section, and setting the forming conditions as toner image forming conditions.

According to the embodiment, the image forming apparatus further includes an image density detecting section, an image density determining section, a second memory section, and a second condition setting section The image density detecting section detects image densities of the plurality of the patch images. The image density determining section determines a patch image having proper image density, depending on a result detected by the image density detecting section. Into the second memory section, forming conditions of the plurality of the toner patches are written. The second condition setting section reads out from the memory section the forming conditions of the toner patch of the patch image having the proper image density, depending on the result detected by the image density determining section, and sets the conditions as toner image forming conditions. Thanks to the configuration as described above, the image forming operation can automatically restart shortly after the detection of malfunction of the patch density detecting section even when such a malfunction occurs, and therefore a desired image can be formed even when a user is absent.

Further, it is preferable that the forming conditions of the toner patches include one or two or more of development bias voltage value, charging voltage value of the image bearing member, and charging voltage value of the electrostatic latent image.

Controls on these voltage values make it easy to form on the image bearing member a toner image having desired toner density.

Further, in an embodiment of the invention, it is preferable that the patch density detecting section comprises:

a light-emitting element for emitting light to the toner patch; and a light-receiving element for detecting a reflection light amount of light emitted from the light-emitting element to the toner patch, and outputting an electric signal converted from the reflection light amount.

According to the invention, the patch density detecting section is preferably a photoelectric sensor which has a light-emitting element and a light-receiving element. The light-emitting element emits light to the toner patch. The light-receiving element detects an reflection light amount of light emitted from the light-emitting element, converts the reflection light amount to an electric signal, and outputs the electric signal. The photoelectric sensor can detect precise patch densities.

Further, in an embodiment of the invention, it is preferable that the image forming apparatus further comprises a light emission control section for controlling the light-emitting element to be switched on and off, and the operation detecting section detects whether or not the patch density detecting section operates properly, based on switch-on and -off of the light-emitting element conducted by the light emission control section.

The operation detecting section is configured so as to detect whether or not the patch density detecting section operates properly, based on switch-on and -off of the light-emitting element conducted by the light emission control section, with the result that an operating state of the patch density detecting section can be detected precisely. For example, when the light-emitting element is switched on and off in a state where the toner patch or toner image is not formed on the image bearing member, no change in output or an output out of a predetermined output variation width will be determined as the malfunction of the patch density detecting section.

Further, it is preferable that the light emission control section controls the light-emitting element to be switched on and off so as to pulse-light the light-emitting element.

The light emission control section controls the light-emitting element to be switched on and off so that the light-emitting section is pulse-lighted, with the result that the operating state of the patch density detecting section can be detected further precisely.

Further, it is preferable that the image forming apparatus further comprises:

a control unit to which is inputted a detected result outputted as an electric signal from the light-receiving element in the patch density detecting section; and a capacitor through which the detected result outputted from the light-receiving element in the patch density detecting section is inputted to the control unit.

The image forming apparatus further includes a control unit and a capacitor. To the control unit is inputted a detected result outputted as an electric signal from the light-receiving element in the patch density detecting section. By way of the capacitor, the detected result outputted from the light-receiving element in the patch density detecting section is inputted to the control unit. Adoption of the configuration as described above can prevent stray light from giving any influence on the detected result, which influence may change the detected result when the patch density is detected by the patch density detecting section. Further, detection sensitivity can be adjusted by pulse width modulation (hereinafter referred to as "PWM").

BRIEF DESCRIPTION OF THE DRAWINGS

Other and further objects, features, and advantages of the invention will be more explicit from the following detailed description taken with reference to the drawings wherein:

FIG. 2 is an overall block diagram of the image forming apparatus shown in FIG. 1;

FIGS. 5A to 5D are views of characteristic waveform showing a relation among a PWN control signal, ON-OFF wave pulse, and a voltage value of DC voltage.

DETAILED DESCRIPTION

Figure 1:
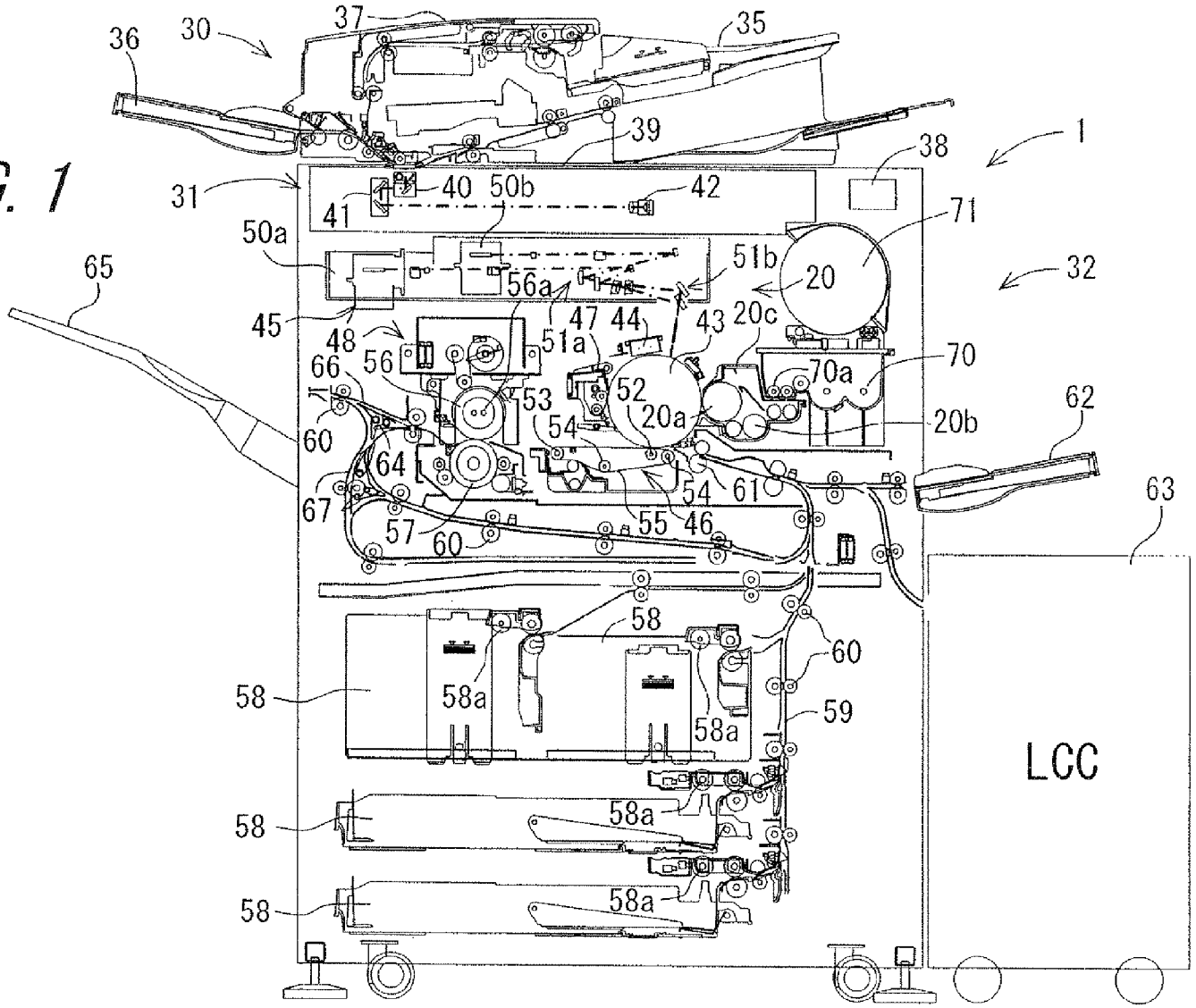
FIG. 1 is a sectional view schematically showing a configuration of an image forming apparatus according to one embodiment of the invention.

Now referring to the drawings, preferred embodiments of the invention are described below.

FIG. 1 is a sectional view schematically showing a configuration of an image forming apparatus 1 according to one embodiment of the invention. The image forming apparatus 1 shown in FIG. 2 has the same configuration as that of a heretofore known image forming apparatus except that a developing device 20 according to the first embodiment of the invention is included. The image forming apparatus 1 forms, for example, a unicolor image on a recording medium such as a recording sheet in accordance with image information which is transmitted through networks from an external equipment such as a personal computer, a digital camera, or a DVD recorder, and image information which is read by a scanner disposed in the image forming apparatus 1. In the present embodiment, the image forming apparatus 1 is configured as a printer for use in forming a unicolor image. The configuration of the image forming apparatus 1 is however not limited to the above configuration and may also be a printer, a copier, a facsimile machine, and the like equipment, which form a multicolor image. The image forming apparatus 1 includes a document conveying section 30, a document reading section 31, an image forming section 32, a sheet discharging section 33, a sheet feeding section 34, and a control unit 38.

The document conveying section 30 includes a first document set tray 35, a second document set tray 36, and a reversing automatic document feeder (abbreviated as RADF) 37. In the embodiment, the first document set tray 35, the second document set tray 36, and the reversing automatic document feeder 37 are formed into a single body. On the first document set tray 35 and second document set tray 36, documents are placed. The reversing automatic document feeder 37 is attached by way of a hinge to a casing in which the later-described document reading section 31 is provided, and located above a document placement table 39 of the document reading section 31 when viewed in a vertical direction. Moreover, the reversing automatic document feeder 37 is rotatable about the hinge. The reversing automatic document feeder 37 conveys the documents which are placed on the first document set tray 35 and second document set tray 36, sheet by sheet to the document placement table 39. The reversing automatic document feeder 37 has also a function of reversing the document whose image has been already read on the document placement table 39, and conveying the document back to the document placement table 39. Furthermore, the documents can be manually placed on the document placement table 39 by rotating the reversing automatic document feeder 37 about the hinge to thereby open a top of the document placement table 39 when viewed in the vertical direction.

The document reading section 31 includes the document placement table 39, a document scanning unit 40, a reflecting section 41, and a charge coupled device (abbreviated as "CCD") line image sensor 42. The document reading section 31 reads image information of a document placed on the document placement table 39 for each bundle of plural lines, for example, for every ten lines. The document placement table 39 is a glass-made platy member for placing thereon documents whose image information is to be read. The document scanning unit 40 includes a light source and a first reflecting mirror. The document scanning unit 40 moves back and forth at a constant speed V in parallel with a lower surface of the document placement table 39 when viewed in the vertical direction so as to irradiate with light an image-formed surface of the document placed on the document placement table 39. Such exposure to the light will form an image of reflected light. The light source is a source of light with which the document placed on the document placement table 39 is irradiated. The first reflecting mirror reflects the image of reflected light toward the reflecting section 41. The reflecting section 41 includes a second reflecting mirror, a third reflecting mirror, and an optical lens. The reflecting section 41 provides an image onto the CCD line image sensor 42, which image is originated from the image of reflected light formed by the document scanning unit 40. The reflecting section 41 moves back and forth at a speed V/2 so as to follow the reciprocating motion of the document scanning unit 40. The second reflecting mirror and the third reflecting mirror reflect the image of reflected light toward the optical lens. The optical lens provides on the CCD line image sensor 42 an image originated from the image of reflected light. The CCD line image sensor 42 includes a photoelectric conversion circuit for photoelectrically converting to an electric signal the image originated from the image of reflected light provided by the optical lens. The CCD line image sensor 42 outputs the image information, i.e., the electric signal to an image processing portion contained in the control unit 38. The image processing portion converts to electric signals of respective colors the image information inputted from the document reading section 31 or an external equipment such as a personal computer, and then outputs the respective electric signals to an exposing unit 45 of the image forming section 32.

The image forming section 32 includes a photoreceptor drum 43, a charging portion 44, the exposing unit 45, the developing device 20, a transferring portion 46, a cleaning unit 47, and a fixing portion 48. The charging portion 44, the exposing unit 45, the developing device 20, the transferring portion 46, and the cleaning unit 47 are disposed around the photoreceptor drum 43 in the order just stated toward a downstream side in a rotation direction of the photoreceptor drum 43. The photoreceptor drum 43 serving as an image bearing member is a roller member which can rotate about an axial line thereof by a driving mechanism (not shown). The roller member used for the photoreceptor drum 43 is composed of, for example, a metal core and a photosensitive layer formed on a surface of the metal core. The metal core is formed of metal such as aluminum and stainless steel. For the photosensitive layer, usable is, for example, a laminate composed of a resin layer containing a charge generating substance and a resin layer containing a charge transporting substance. On the photosensitive layer is formed an electrostatic latent image which will turn to a toner image, as described later. The charging portion 44 charges a surface of the photoreceptor drum 43 at predetermined polarity and potential. For the charging portion 44, usable is, for example, a contact or noncontact charger such as a charger-type charger, a roller-type charger, or a brush-type charger.

The exposing unit 45 emits signal light corresponding to the image information toward the surface of the photoreceptor drum 43 charged by the charging portion 44, thereby forming an electrostatic latent image on the surface of the photoreceptor drum 43. For the exposing unit 45, useable is, for example, a laser scanning unit (abbreviated as LSU) composed of laser emitting portions 50*a* and 50*b* including a semiconductor laser, and reflecting mirrors 51*a* and 51*b*. The semiconductor laser element emits laser light (signal light) in form of dot light which is modulated in accordance with a pixel signal inputted form the image processing portion. The reflecting mirror leads the laser light which has been emitted from the semiconductor laser element, to the surfaces of the photoreceptors 43 of respective colors.

The developing device 20 includes a developing roller 20*a*, a supplying roller 20*b*, and a developer tank 20*c*. The developing roller 20*a* is a roller-shaped member which is in pressure-contact with the surface of the photoreceptor drum 43 and able to rotate by a driving mechanism (not shown). A pressure-contact area formed between the developing roller 20*a* and the photoreceptor drum 43 is a development nip area. At the development nip area, the developing roller 20*a* supplies a toner to the electrostatic latent image on the surface of the photoreceptor drum 43, thereby forming a toner image. To the developing roller 20*a* is applied development bias voltage. The supplying roller 20*b* is a roller-shaped member which is in pressure-contact with the developing roller 20*a* and able to rotate by a driving mechanism (not shown). The supplying roller 20*b* supplies developer containing a toner to the developing roller 20*a*. The developer tank 20*c* is a container-shaped member having an internal space where the developer is contained, and supports the developing roller 20*a* and the supplying roller 20*b* so that the rollers can rotate. In the developing device 20, the developer contained in the developer tank 20*c* is attached to the surface of the developing roller 20*a* by rotation of the supplying roller 20*b* and furthermore at the development nip area, the developer on the surface of the developing roller 20*a* is supplied to the electrostatic latent image on the surface of the photoreceptor drum 43. The electrostatic latent image is then developed to be a toner image.

The developer tank 20*c* is replenished with a toner by a toner replenishing portion, depending on a toner consumption situation of the developer tank 20*c*. The toner replenish portion includes a toner hopper 70 and a toner bottle 71. The toner hopper 70 is a container-shaped member having an inner space where the toner is stored. The developer tank 20*c* and the toner hopper 70 are connected to each other so as to be positioned partly one above the other when viewed in the vertical direction. Such a juncture part between the developer tank 20*c* and the toner hopper 70 is provided with a through hole (not shown) which extends in the vertical direction so that an internal space of the developer tank 20*c* and an internal space of the toner hopper 70 communicate with each other. There is provided a toner replenishing roller 70*a* above an opening of the through hole on a side of the toner hopper 70 when viewed in the vertical direction. The toner replenishing roller 70*a* is a roller-shaped member which can rotate by a driving mechanism (not shown.). The rotation of the toner replenishing roller 70*a* causes the toner inside the toner hopper 70 to be supplied into the developer tank 20*c*. The toner bottle 71 is a cylindrical member whose internal space is filled up with the toner. The toner bottle 71 is disposed above the toner hopper 70 when viewed in the vertical direction, so as to be rotatable about an axial line thereof by a driving mechanism (not shown) and detachable on a main body of the image forming apparatus 1. The toner bottle 71 has an opening (not shown) extending in a longitudinal direction thereof. The rotation of the toner bottle 71 causes the toner to fall from the opening, thereby replenishing the toner hopper 70 with the toner. When the toner contained in the toner bottle 71 is used up, the toner bottle 71 is replaced by a new toner bottle 71.

The transferring portion 46 includes a transferring roller 52, a driving roller 53, a tension roller 54, and a conveying belt 55. The transferring roller 52 is a roller-shaped member which is disposed in pressure-contact with the surface of the photoreceptor drum 43 via the conveying belt 55 so as to be rotatably supported by a supporting portion (not shown) and able to rotate by a driving mechanism (not shown). A pressure-contact area between the transferring roller 52 and the photoreceptor drum 43 is a transfer nip area. To the transferring roller 52 is connected a power source (not shown) and thereby applied the transfer bias. The driving roller 53 can rotate by a driving mechanism (not shown) and drives the conveying belt 55 to move around. The tension roller 54 is rotatably supported and gives proper tension to the conveying belt 55 so that the conveying belt 55 can smoothly move around. The conveying belt 55 is an end-less belt member which is stretched out on the driving roller 53 and the tension roller 54 to thereby form a loop-shaped travel path. The conveying belt 55 moves around from the transfer nip area toward the fixing portion 48 and conveys to the fixing portion 48 a recording medium onto which a toner image is transferred at the transfer nip area. In the transferring portion 46, the transfer bias voltage is applied to the recording medium from the transferring roller 52-side thereof, whereby the recording medium is charged, and at the same time, the recording medium is pressurized by the transferring roller 52 so that the toner image on the surface of the photoreceptor drum 34 is transferred onto the recording medium, followed by conveyance of the recording medium toward the fixing portion 48. Note that the recording medium is fed from the later-described sheet feeding section 34 to the transfer nip area in synchronization with exposure effected by the exposing unit 45.

The cleaning unit 47 includes a cleaning blade. The cleaning blade is a platy member which is made of an elastic material, for example, and disposed in contact with the surface of the photoreceptor drum 43. The cleaning blade is used to remove the toner, paper dusts, etc. which still remain on the surface of the photoreceptor drum 43 after the toner image has been transferred to the recording image.

The fixing portion 48 includes a fixing roller 56 and a pressurizing roller 57. The fixing roller 56 is a roller-shaped member which can rotate by a driving mechanism (not shown). The fixing roller 56 has a heating portion therein. For the heating portion, usable is a halogen lamp, an infrared lamp, or the like device. The pressurizing roller 57 is a roller-shaped member which is rotatably supported and disposed in pressure-contact with the fixing roller 56. A pressure-contact area between the fixing roller 56 and the pressurizing roller 57 is a fixing nip area. When the recording medium passes through the fixing nip area, the recording medium is heated by the heating roller 56 and pressurized by the pressurizing roller 57. In the fixing portion 48, the recording medium onto which the toner image has been transferred by the transfer portion 46 of the image forming section 32, is fed to the fixing nip area where the recording medium is heated and pressurized so that the toner image is fixed on the recording medium, thus forming an image.

In the image forming section 32, the surface of the photoreceptor drum 43 is charged by the charging portion 44, and the exposing unit 45 irradiates the charged surface of the photoreceptor drum 43 with signal light corresponding to the image information, in the consequence whereof an electrostatic latent image is formed on the surface of the photoreceptor drum 43. To the electrostatic latent image, the toner is supplied from the developing device 20 to thereby form a toner image which is then transferred by the transferring portion 46 onto the recording medium. The surface of the photoreceptor drum 43 onto which the toner has been transferred, is cleaned by the cleaning unit 47 which removes the remaining toner, etc. A series of the operations just stated is repeated to thereby form an image. And then, the recording medium onto which the toner image has been transferred, is conveyed to the fixing portion 48 where the toner image is fixed on the recording medium.

The sheet discharging section 33 includes a plurality of conveying rollers 60, a switching gate 64, a catch tray 65, a first conveying path 66, and a second conveying path 67. The plurality of the conveying rollers 60 are provided in the first conveying path 66 and the second conveying path 67 to thereby convey the recording medium in a predetermined direction. The switching gate 64 switches the conveying path of the recording medium between the first conveying path 66 and the second conveying path 67. In the case of forming an image only on a single side of a recording medium, or in the case of conveying a recording medium on both sides of which images have been formed, the switching gate 64 operates so as to lead the recording medium to the first conveying path 66 and discharge the recording medium to the catch tray 65. In the case of conveying a recording medium on one side of which an image has been formed and on another side of which an image is being formed, the switching gate 64 operates so as to lead the recording medium to the second conveying path 67. The catch tray 65 is disposed so as to extend from a side surface of the image forming apparatus 1 toward outside thereof when viewed in the vertical direction. On the catch tray 65 is placed and temporarily stored a recording medium discharged from inside of the image forming apparatus 1, on which recording medium an image has been already formed. The first conveying path 66 is a path for discharging a recording medium on which the image formation has been completed. The second conveying path 67 is a path for use in forming an image on one side of a recording medium and further forming an image on another side of a recording medium. The second conveying path 67 is connected to the later-described sheet feeding path 59. In the sheet discharging section 33, a recording medium on which the image formation has been completed, is discharged to the catch tray 65 and in the case of forming images on both sides of a recording medium, the recording medium is fed back to the sheet feeding path 59 through the second conveying path 67.

The sheet feeding section 34 includes a sheet feeding tray 58, a pickup roller 58*a*, a sheet feeding path 59, a conveying roller 60, a registration roller 61, a manual tray 62, and a large capacity cassette (abbreviated as LCC) 63. The sheet feeding tray 58 is a tray for storing a recording medium such as regular paper, coated paper, a color copy sheet, or an OHP film. The number of the sheet feeding tray 58 is plural. In respective sheet feeding trays 58 are contained differently-sized recording mediums. The size of the recording medium includes A3, A4, B5, and B4. A plurality of the sheet feeding trays 58 may contain the recording mediums of the same size. In replenishing the sheet feeding tray 58 with the recording mediums, the sheet feeding tray 58 is drawn to a front side (an operation side) of the image forming apparatus 1. The pickup roller 58*a* helps to separate the recording mediums from each other, which recording mediums are contained in the sheet feeding tray 58, then feeding the separated recording mediums sheet by sheet to the sheet feeding path 59. A plurality of the conveying rollers 60 are provided along the sheet feeding path 59 and feed the recording medium toward the registration roller 61. The registration roller 61 temporarily holds the recording medium therebetween, and sequentially feeds the recording medium to the transfer nip area in synchronization with the exposure to the surface of the photoreceptor drum 43 conducted by the exposing unit 45 in the image forming section 32. The manual tray 62 is used to provide the recording medium whose size is irregular, for example. The large capacity cassette 63 is a high-capacity sheet feeding tray in which, for example, frequently-used recording mediums such as A4-sized sheets are contained. This prevents the sheets from running out in mid-course of the image formation. In the sheet feeding section 34, the recording medium contained in the sheet feeding tray 58 is supplied to the image forming section 32 by way of the pickup roller 58*a* and the registration roller 61.

The patch density detecting section 80 is disposed, for example, on a downstream side of the developing device 20 in a rotation direction of the photoreceptor drum 43 so that the patch density detecting section 80 faces the photoreceptor drum 43. The patch density detecting section 80 is electrically connected to the later-described control unit 38. For the patch density detecting section 80, various sensors can be used and preferable is a photoelectric sensor. The photoelectric sensor includes a light-emitting element and a light-receiving element. The light-emitting element emits light of a predetermined wavelength toward the toner patch formed on the surface of the photoreceptor drum 43. The light-receiving element detects an reflection light amount of light emitted from the light-emitting element, and converts the amount into an electric signal which is then sent to the control unit 38. The patch density detecting section 80 is used in the process control performed by the later-described toner density adjusting section. Note that the patch density detecting section 80 may be connected to the control unit 38 via a capacitor such as a coupling capacitor. The coupling capacitor is characterized in, for example, having sensitivity to electric signals of around a few hundred Hz to a few kHz while shutting out electric signals of a few dozen Hz and being unable to follow electric signals over a few dozen kHz. The use of the coupling capacitor as just described will allow the electric signals of a few dozen Hz to be removed which signals cannot be discriminated from power-supply noise, thus enabling the PWM and thus the sensitivity adjustment. Moreover, the electric signal outputted from the light-receiving element can be prevented from being subject to modulation caused by stray light. The image density detecting section 81 is disposed, for example, at such a position on a side surface of the image forming apparatus 1 on which side surface is provided with the catch tray 65, that the image density detecting section can detect image density of an image on the recording medium discharged to the catch tray 65. The image density detecting section 81 is electrically connected to the later-described control section 38. For the image density detecting section 81, preferably used is a photoelectric sensor of the same type as that used for the patch density detecting section 80.

The control unit 38 includes, for example: a memory which is provided in an upper part of an internal space of the image forming apparatus 1 and referred to also as a memory section; and a central processing unit (abbreviated as CPU) which serves as both of a calculating portion and a control portion. Into the memory are written a detected result, various set values, image information, table data, program, and so forth. For the memory section, available are devices customarily used in the relevant field, including, for example, a read only memory (abbreviated as ROM), a random access memory (abbreviated as RAM), and a hard disc drive (abbreviated as HDD). The calculating portion takes out various data (a print command, a detected result, image information, etc.) which are inputted into the memory section, and programs for performing various controls, thereby conducting various detections and/or determinations. The control portion sends a control signal to the apparatus in accordance with a determined result obtained in the calculating portion, thus performing an operational control. The central processing unit is a processing circuit realized by a microcomputer, a microprocessor, etc. The control unit 38 includes a main power source together with the memory section, the calculating portion, and the control portion.

FIG. 2 is an overall block diagram of the image forming apparatus 1 shown in FIG. 1. The control unit 38 of the image forming apparatus 1 includes an operation panel board 100, a machine control board 200, a CCD board 300, a main image processing board 400, a sub image processing board 500, and a group of the other expansion board 600. In the image forming apparatus 1, information is inputted from a sub central processing units (CPU) 101 and 201 disposed in respective unit parts to a main central processing unit (CPU) 401, and in accordance with the information, the main central processing unit (CPU) 401 conducts various determinations and sends a control signal to each of the sub central processing units 101 and 201 in accordance with the determined result, whereby the operational control is carried out.

The operation panel board 100 is controlled basically by a sub central processing unit 101. The operation panel board 100 regulates, for example, a display screen of a liquid crystal display (LCD) 104 disposed in an operation panel 103, and manipulated input provided by an operation key group 105 which is used for inputting commands regarding various modes. The sub central processing unit 101 carries out control information communication with the main central processing unit 401, thereby controlling the operation of the image forming apparatus 1. A control signal indicative of an operating state of the image forming apparatus 1 is transferred from the main central processing unit 401 to the sub central processing unit 101, and the sub central processing unit 101 displays the transfer of control signal on the liquid crystal display 104, thereby informing a user of the operating state of the image forming apparatus 1. Into a memory 102 are written information for display on the liquid crystal display 104, information inputted by the operation key group 105, and various control information such as a command in the operation panel 103.

The machine control board 200 includes a sub central processing unit 201 and a memory 202. The sub central processing unit 201 controls the reversing automatic document feeder 37, the document reading section 31, the image forming section 32, the sheet feeding section 34, and a double-side unit 207. For the reversing automatic document feeder 37, usable is an auto document feeder (abbreviated as ADF), a reversing automatic document feeder (abbreviated as RADF), or the like device. The document reading section 31 reads a document image. The image forming section 32 reproduces image information as an image. The charging portion 44 in the image forming section 32 is capable of adjusting toner density by adjusting a potential for charging the photoreceptor drum 43. The development bias voltage value applied to the developing roller 20*a* is also important for the adjustment of the toner density. A sensor unit 208 controls various sensors disposed in the patch density detecting section 80, the image density detecting section 81, and the other parts of the image forming apparatus 1. A detected result obtained by a detecting section such as the patch density detecting section 80 or the image density detecting section 81 is inputted by the sensor unit 208 to the sub central processing unit 201 and written in the memory 202. The sheet feeding section 34 sequentially conveys the recording medium on which an image is to be formed, from the sheet feeding tray 58 toward the image forming section 32. The double-side unit 207 controls various operations of the sheet discharging section 33 and an operation of feeding the recording medium toward the second conveying path 67 through the switching gate 64.

The CCD board 300 includes a CCD line image sensor 301, a CCD gate array 302, an analog circuit 303, and an A/D converter 304. The CCD board 300 is controlled by the main central processing unit 401. The CCD line image sensor 301 electrically reads the document image. The CCD gate array (abbreviated as CCDG/A) 302 is a circuit for driving the CCD 301. The analog circuit 303 carries out the gain adjustment of analog data outputted by the CCD line image sensor 301. The A/D converter 304 converts the analog output of the CCD line image sensor 301 to a digital signal, then outputting the digital signal as electronic data.

The main image processing board 400 includes the main central processing unit 401, a multivalued image processing portion 402, a memory 403, and a laser control 404. The main central processing unit 401 controls an entire operation of the main image processing board 400. The multivalued image processing portion 402 treats multivalued image information (the electronic data of the document image) inputted by the CCD board 300, with processes such as shading correction, density correction, region separation, filtering, MTF correction, resolution conversion, electronic zooming (variable power), and gamma correction. Into the memory 403 are written, for example, image information processed by the multivalued image processing portion 402, and various control information such as process procedure of the multivalued image processing portion 402. The laser control 404 sends the image information toward a laser scanning unit (LSU) 406 in accordance with the image information processed by the multivalued image processing portion 402.

The sub image processing board 500 includes a binary image processing portion 501, a gate array 502, an RDH gate array 503, and an SCSI gate array 504. The sub image processing board 500 is jointed to the main image processing board 400 with the aid of a connector, thereby being controlled by the main central processing unit 401. The binary image processing portion 501 includes a conversion processing portion, a rotation processing portion, a binary variable power (zooming) processing portion, a compression and extension processing portion, and a fax interface (FAX I/F). The conversion processing portion converts the multivalued image information into a binary image. The rotation processing portion rotates an image. The binary variable power processing portion treats the binary image with the variable power process. The compression and extension processing portion treats the binary image with a compression process and/or an extension process. The fax interface sends and receives a fax image through a network (not shown) to which the image forming apparatus 1 is connected. The gate array 502 includes a memory 502*a* and a memory gate array 502*b*. Into the memory 502*a* are written, for example, the binary image information which has been treated with an image processing by the binary image processing portion 501, and the control information for use in the image processing. The memory gate array 502*b* controls the memory. The RDH gate array (abbreviated as RDH G/A) 503 controls a hard disc (abbreviated as HD) 503*a*. The hard disc 503*a* stores and manages image information of plural documents. The image information stored in the hard disc 503*a* is utilized for obtaining plural copies by reading out document images on the plural documents repeatedly for the desired number of copies. The SCSI gate array 504 includes SCSI-2 ports 504*a* and 504*b* which serve as external interfaces. The SCI gate array 504 controls the SCSI-2 ports 504*a* and 504*b*.

The expansion board group 600 includes a printer board 601, a function expansion board 602, and a fax board 603. The printer board 601 is provided for the purpose of enabling a printer portion of the image forming apparatus 1 to output in a printer mode the image information which is inputted from an external equipment connected to the image forming apparatus 1 through a network. The function expansion board 602 is provided for the purpose of expanding an edit function of the image forming apparatus 1 so as to effectively utilize the features of the image forming apparatus 1. The fax board 603 is provided for the purpose of sending a document image read by the document reading section 31 of the image forming apparatus 1 and outputting the received image information from the printer portion of the image forming apparatus 1.

In the image forming apparatus 1, an operation of copy mode is carried out, for example, as follows. Documents placed at a predetermined position on the reversing automatic document feeder 37 of the image forming apparatus 1 are sequentially supplied sheet by sheet onto the document placement table 39 where images on the document are read, and sent in form of 8-bit electronic information to the main image processing board 400. The 8-bit electronic information transferred to the main image processing board 400 is treated by the multivalued image processing portion 402 with a predetermined process as 8-bit electronic image information, and then sent to the laser scanning unit 406 via the laser control 404. The image information of document read by the document reading section 31 as just described is outputted as a gray-scale copy image from the laser scanning unit 406.

The operation of the copy mode using the electronic RDH function is carried out, for example, as follows. The operation proceeds just as the above-described operation of copy mode until the image information of the document read by the document scanning unit 40 is treated with the process as the 8-bit electronic image information by the multivalued image processing portion 402. The 8-bit electronic image information processed by the multivalued image processing portion 402 is sent from the main image processing board 400-side connector 405 to the sub image processing board 500 via the sub-image processing board 500-side connector 505. At a multivalue-binary converting portion of the binary image processing portion 501, the 8-bit electronic image information is treated with error diffusion, etc. and converted to a 2-bit electronic image information. Note that the reason why the 8-bit electronic image information is treated with the error diffusion, etc. to be thereby converted to the 2-bit electronic image information, is to lessen deterioration of an image since image quality may be insufficient when only a multivalue-binary conversion is performed. Moreover, the 8-bit electronic image information is converted to the 2-bit electronic image information because a memory capacity, etc. for images is taken into consideration. As described above, the 2-bit electronic image information thus converted is temporarily stored and controlled by the hard disc 503*a* of the RDH gate array 503 for each sheet of the documents.

After completion of reading all of the plural documents placed on the reversing automatic document feeder 37 of the image forming apparatus 1, the 2-bit electronic image information stored in the hard disc 503*a* is repeatedly read out for the designated print number by control of the RDH gate array 503. The readout 2-bit electronic image information is sent back to the main image processing board 400 via the connectors 405 and 505, and thus treated with the gamma correction, etc., thereafter being sent to the laser scanning unit 406 via the laser control 404. The image information of document read by the document reading section 31 as just described is outputted as a gray-scale copy image from the laser scanning unit 406. Although such a configuration is described that the desired number of the desired image is repeatedly read out after the images of all the documents have been read out, also available is a configuration that an image output for a first copy is sequentially carried out at a stage when a preparation for outputting the predetermined number of images has been completed.

Further, in the image forming apparatus 1, an operation of printer mode is carried out, for example, as follows. The image information inputted from an external equipment to the image forming apparatus 1 via a network is developed on the printer board 601 as an image on a per-page basis and then sent once from the SCSI-2 port 504*a* serving as an interface to the sub image processing board 500 where the image information is written in the hard disc 503*a*. Note that the image developed on the printer board 601 as an image on the per-page basis is sent to the sub image processing board 500 and not treated with the binary image process, thus being directly written in the hard disc 503*a* temporarily. Moreover, no binary image process is applied to the image even when the image is being read out from the hard disc 503*a*. The image information on the per-page basis is read out from the hard disc 503*a* in a predetermined page order, and sent to the main image processing board 400 where the image information is treated with the gamma correction, thereafter being sent to the laser scanning unit 406 via the laser control 404 so that an image is printed.

The fax mode in the image forming apparatus 1 includes a document-sending operation and a document-receiving operation. The sending operation is carried out, for example, as follows. Documents placed at a predetermined position on the reversing automatic document feeder 37 of the image forming apparatus 1 are sequentially supplied sheet by sheet onto the document placement table 39 where images on the documents are sequentially read by the document scanning unit 40, and sent in form of 8-bit electronic information to the main image processing board 400. The 8-bit electronic information is treated by the multivalued image processing portion 402 with a predetermined process as 8-bit electronic image information. Subsequently, the 8-bit electronic information is sent from the main image processing board 400-side connector 405 to the sub image processing board 500 via the sub-image processing board 500-side connector 505. At the multivalue-binary converting portion of the binary image processing portion 501, the 8-bit electronic image information is treated with error diffusion, etc. and converted to 2-bit electronic image information. A thus-binarized image on a sent document is compressed in a predetermined format and written in the memory 502*a*. And then, a sending procedure is taken for the sending side, and after a transmittable state is secured, the compressed image on the sent document is read out from the memory 502*a* and sequentially sent toward a destination through a communication circuit.

The receiving operation is carried out, for example, as follows. When the document is sent from the sending side through the communication circuit, the fax board 603 takes a communication procedure and while doing so, the fax board 603 receives the document image sent from the sending side. The document image is received in a state of being compressed in the predetermined format, and the fax board 603 sends the document image to the binary image processing portion 501 via a fax interface (FAX I/F) provided in the binary image processing portion 501 of the sub image processing board 500. The document image is then reproduced as image information on the per-page basis in the compression and extension processing portion, etc. Such per-page basis image information is transferred to the main image processing board 400-side where the image information is treated with the gamma correction, thereafter being sent to the laser scanning unit 406 via the laser control 404 so that an image is printed.

In the image forming apparatus 1, the various controls are carried out with the aid of the sub central processing unit 201 and the memory 202 in the machine control board 200. Into the memory 202, elements for performing the various controls are written, including a program, data table, figures to serve as reference values for the controls, and results detected by the patch density detecting section 80, the image density detecting section 81, and the other sensors. The sub central processing unit 201 reads out the program for performing the various controls from the memory 202, thus carrying out the various controls. For a display operation of the later-described display section, the sub central processing unit 101 and the memory 102 in the operation panel board 100 are utilized.

In the embodiment, in the case where the patch density detecting section 80 of the image forming apparatus 1 operates properly, the patch forming section, the image density detecting section 81, a toner density adjusting section, and an operation detecting section are used, and when necessary, a light emission control section is also used. The patch forming section controls the image forming section 32, thereby forming on the surface of the photoreceptor drum 43 a toner patch which is a toner image for detecting the toner density. The toner patch is, for example, composed of eight squares, each of which is about 8 cm on a side. The toner patch forming section forms under different forming conditions a plurality of the toner patches whose toner density, i.e., patch density is different from each other in sequence. The plurality of the toner patches are preferably formed so as to correspond to the print density which can be set in the image forming apparatus 1. Specific examples of the forming conditions include a value of development bias voltage applied to the developing roller 20*a*, a value of charging voltage (charge potential) applied to the surface of the photoreceptor drum 43, and a value of charging voltage (exposure potential) of an electrostatic latent image which is formed on the surface of the photoreceptor drum 43 by the exposing unit 45. Among such examples, one or two or more of the conditions are fixed at certain values while the other conditions are properly modified, and under such conditions, a plurality of toner patches are formed whose patch density is different from each other in sequence. A plurality of the toner patches may be thus formed, for example, with the charge potential and exposure potential fixed and with the development bias voltage value modified. The conditions for forming a plurality of the toner patches are inputted to the memory 202. The patch density detecting section 80 detects patch density of the toner patch formed on the surface of the photoreceptor 43. A result (hereinafter referred to as "a patch density detected result") detected by the patch density detecting section 80 is inputted to the memory 202. Into the memory 202 has been previously written a patch density reference value set in designing the image forming apparatus 1. The patch density reference value is written, for example, as a reference reflection light amount for the case of monochrome images and as an amount of scattered light for the case of color images. After the patch density is detected by the patch density detecting section 80, the toner patch is removed by the cleaning unit 47 from the surface of the photoreceptor drum 43. The toner density adjusting section takes out from the memory 202 the patch density detected result and the patch density reference value which are then compared to each other to determine the development bias voltage value corresponding to the patch density reference value. The development bias voltage value is then written into the memory 202. Subsequently, the toner density adjusting section reads out from the memory 202 the development bias voltage value corresponding to the patch density reference value. The development bias voltage value is used as a condition for forming a toner image in the next image formation.

Figure 3A:
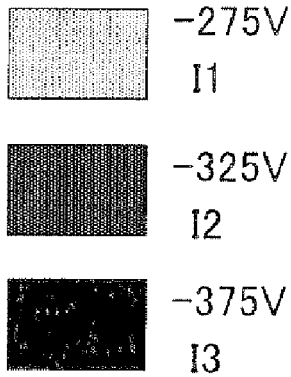
FIGS. 3A and 3B are views for assisting explanation of toner density adjustment with FIG. 3A showing three types of monochrome toner patches and FIG. 3B showing a graph of a relation between an reflection light amount and development bias voltage.
Figure 3B:
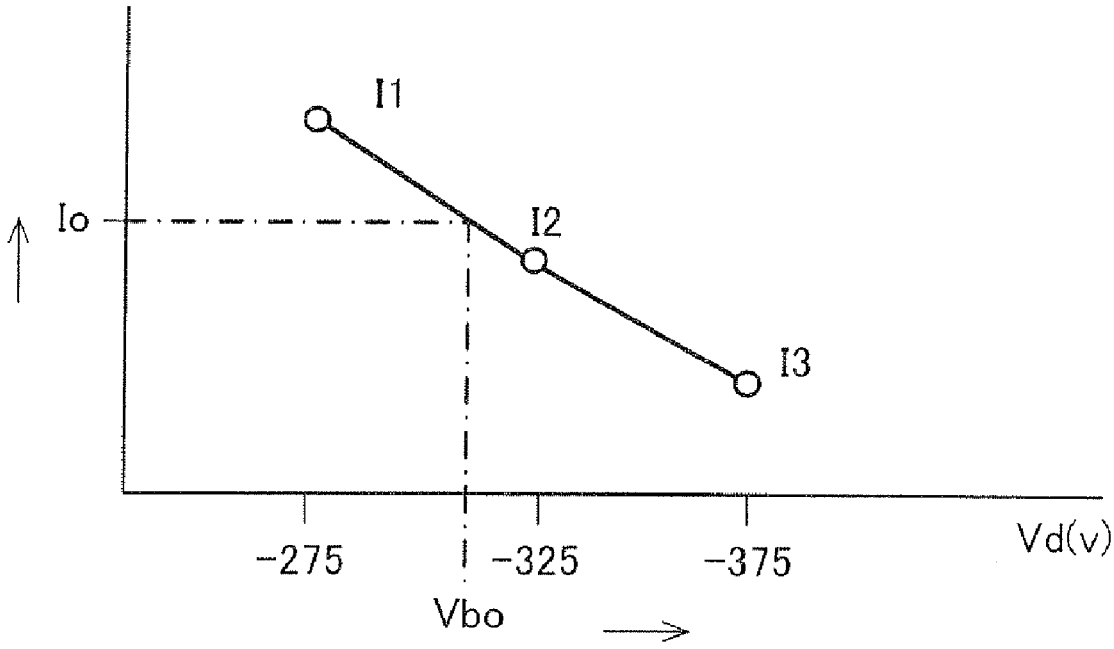

Specific examples of the toner density adjustment effected by the toner density adjusting section are as follows. FIGS. 3A and 3B are views for assisting explanation of the toner density adjustment. FIG. 3A shows three types of monochrome toner patches formed on the photoreceptor drum 43. FIG. 3B shows a graph of a relation between the reflection light amount which amount is determined by the three types of the toner patches shown in FIG. 3A, and the development bias voltage. In this case, a corona charger having a corona electrode and a grid electrode is used as a charging portion 44. As a light source for the exposing unit 45, a semiconductor laser is used which emits laser light as signal light. The grid voltage Vg which is applied to the grid electrode of the charging portion 44 is fixed at −600V. Moreover, the laser power of the exposing unit 45 is fixed at 100%. The development bias voltage Vb is switched among −275V, −325V, and −375V, and three toner patches are thus fabricated. The patch density detecting section 80 reads the patch densities (the reflection light amount) I1, I2, and I3 of the three type of the toner patches. The patch densities are plotted in a graph whose vertical axis represents the reflection light amount I and whose horizontal axis represents the development bias voltage Vb. Straight lines are drawn which indicate a relation between the reflection light amount and the development bias voltage, by connecting the patch densities I1, I2, and 13. On the basis of the straight lines, the development bias voltage Vbo is obtained which corresponds to the reference patch density (the reference reflection light amount) Io. The development bias voltage Vbo is set at the development bias voltage value for the next image formation. Note that in the case of Vg−Vbo>−150 V, the grid voltage is modified so that Vg=Vbo−150 is satisfied. In the next toner density adjustment, the development bias voltage is switched among (Vbo+50), Vbo, and (Vbo−50) based on the development bias voltage Vbo written in the memory 202, whereby three toner patches are fabricated, thus performing an operation of the same sort as described above. The toner density adjustment as just stated is usually referred to as high-density correction. The high-density correction is carried out, for example, upon power activation, when a temperature of the fixing portion 48 is equal to or lower than 45° C. in a non-standby state, when the number of printed sheet reaches 1,000 after previous high-density correction, when the toner density adjustment corresponding to humidity change is performed, upon replacing the photoreceptor drums and upon replacing the developer.

Figure 4A:
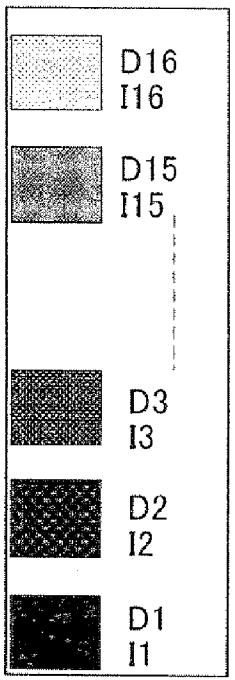
FIGS. 4A to 4D are view for assisting explanation of toner correction.
Figure 4B:
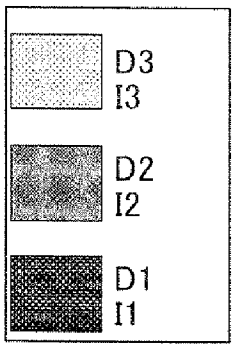
Figure 4C:
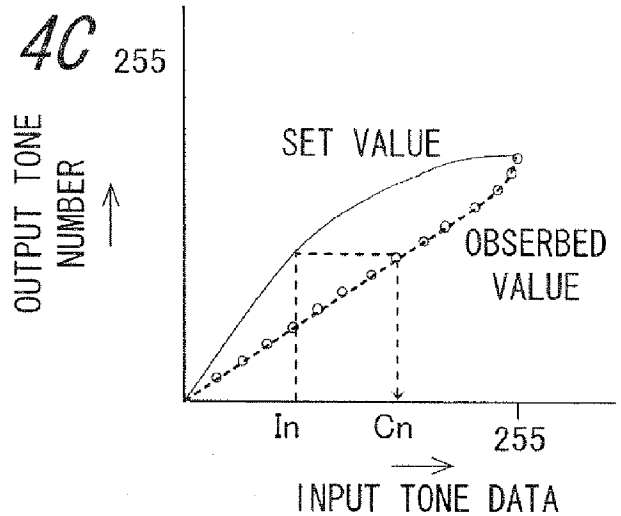
Figure 4D:
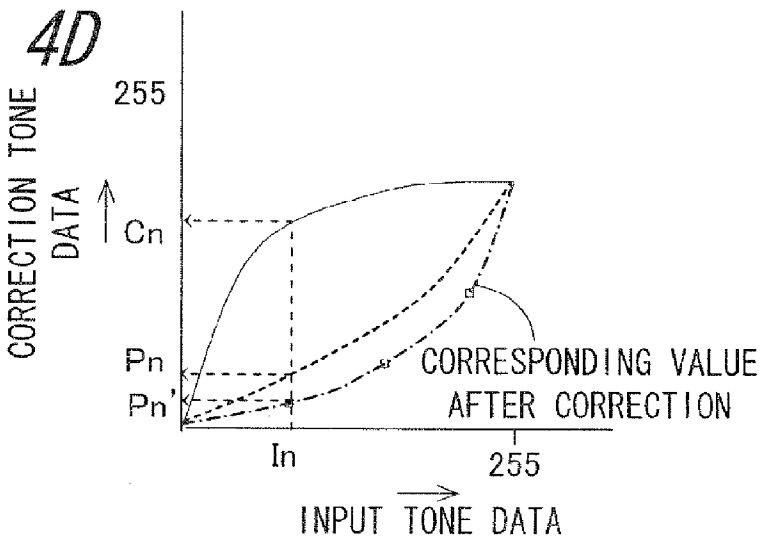

The tone correction may be applied after the high-density correction. FIGS. 4A to 4D are view for assisting explanation of the tone correction. FIG. 4A is a view for showing a toner patch in the copy mode, which toner patch is fabricated for the tone correction. FIG. 4B is a view for showing a toner patch in the printer mode, which toner patch is fabricated for the tone correction. FIG. 4C is a graph for showing a relation between input tone In and a set value and observed value of output tone in the copy mode. FIG. 4D is a graph for showing a relation between input tone In and a set value, observed value, and correction value of output tone in the printer mode. In the correction, a tone number-test patch table from which the graph of FIG. 4C is originated, is referred to thereby fabricate sixteen toner patches of tone numbers D1 to D16. The patch density detecting section 80 is used to measure patch density I1 to I16 of the sixteen toner patches. The measured values are plotted as shown in FIG. 4C. A change in the observed value of output tone relative to the input tone In is determined based on straight-line approximation (primary expression):

$$\mathrm{Count}(In)=\alpha\cdot In \quad (1)$$

(wherein α is a constant). Next, such a modified input tone Cn is obtained that the observed value of output tone becomes the same as the set value of output tone corresponding to the input tones In of sixteen kinds. That is to say, the above formula (1) is used to obtain Cn by back calculation, which satisfies the following formula:

$$\mathrm{Cref}(In)=\mathrm{Count}(Cn) \quad (2).$$

Such a Cn is determined by Cn=Cref(In)/α. Subsequently, correction coefficients An=Cn/In of sixteen kinds are determined concerning the input tones In and Cn of sixteen kinds. On the basis of the correction coefficients An of sixteen kinds, the correction coefficients An and the modified input tones Cn which correspond to all the input tones In, are determined. And then, a modified table for copy is fabricated which contains the modified input tones Cn(=An·In) corresponding to all the input tones In.

Next, three toner patches are fabricated in the printer mode, which correspond to the input tones of three kinds shown in FIG. 4B. From the memory 202 are read out output tone values (set value: Pref) corresponding to the input tones of sixteen kinds used in fabricating the above modified table for copy and which are ideal for use in the printer mode. Furthermore, the tones Count of the toner patches of sixteen kinds determined in fabricating the modified table for copy are read out from the memory 202. In this state, tones Pout of three toner patches are measured, and a patch modifying coefficient Da is calculated by using the following formula:

$$Da=P\mathrm{out}/C\mathrm{out} \quad (3).$$

Next, a change in the observed value Pout of output tone relative to the input tone In is determined based on an approximate expression which is obtained by straight-line approximation (primary expression):

$$P\mathrm{out}(In)=\beta\cdot In \quad (4)$$

(wherein β is a constant). This allows a patch-lacking part to be covered.

Subsequently, on the basis of the observed value Cout and the patch modifying coefficient Da, a modified output tone P'out is determined by the following formula:

$$P'\mathrm{out}=C\mathrm{out}\cdot Da \quad (5).$$

A change in the modified output tone P'out relative to the input tone In is determined by quadratic curve approximation. That is to say, there is obtained an approximate expression:

$$P'\mathrm{out}=(In)=a\cdot In^2+b\cdot In+c \quad (6)$$

(wherein a, b, and c are constants).

Using a formula (6), Pn is obtained by back calculation, which satisfies the following formula:

$$P\mathrm{ref}(In)=P'\mathrm{out}(Pn) \quad (7).$$

Next, correction coefficients Anp=Pn/In are determined concerning the input tones In and Pn of sixteen kinds. On the basis of the correction coefficients Anp of sixteen kinds, the correction coefficients Anp and the modified input tones Pn(=Anp·Tn) corresponding to all the input tones In, are determined. And then, a modified table for printer is fabricated which contains the modified input tones Pn corresponding to all the input tones In. All the processes in the tone correction are carried out in the sub main central processing unit 201. The tone correction is carried out, for example, when the high-density correction changes the development bias voltage by 45 V or more, upon replacing the photoreceptor drum, and upon replacing the developer. Note that the high-density correction and the tone correction are described in detail in Japanese Unexamined Patent Publication JP-A 2006-110913, for example.

The operation detecting section detects whether or not the patch density detecting section 80 operates properly. When the patch density detection section 80 operates properly, the detected result of patch density is converted to an electric signal which is then sent to the sub central processing unit 201 at regular intervals. Accordingly, the operation detecting section detects whether or not the signal is sent from the patch density detecting section 80 to the sub central processing unit 201 at regular intervals. When the electric signal is sent at regular intervals, a determination is made that the patch density detecting section 80 operates properly, and when the electric signal is not sent at regular intervals, a determination is made that the patch density detecting section 80 does not properly operate. The result detected by the operation detecting section is written into the memory 202 and also sent to the sub central processing unit 101 of the operation panel board 100 where the result is then written into the memory 102. The sub central processing unit 101 displays the result detected by the operation detecting section, on the liquid crystal display 104 of the operation panel 103. The operation panel 103 is provided, for example, on an upper surface of the image forming apparatus 1 when viewed in the vertical direction. Note that instead of using the sub central processing unit 201 to directly detect the signal sent from the path detecting section 80, also available is such a configuration that the signal is detected by an analog/digital converter (abbreviated as ADC) (not shown) disposed between the patch density detecting section 80 and the sub central processing unit 201, and a result detected by the converter is sent to the sub central processing unit 201.

Further, the operation detecting section may use the light emission control section to detect whether or not the patch density detecting section 80 operates properly. The light emission control section controls the light-emitting element of the patch density detecting section 80 so that the light-emitting element is repeatedly lighted and blacked out (ON/OFF) in a continuous fashion. In this case, the light emission control section pulse-lights the light-emitting element, thereby allowing for more precise detection of whether or not the patch density detecting section 80 operates properly. Further, a capacitor such as a coupling capacitor is connected to a part located between the patch density detecting portion 80 and the sub central processing unit 201, and the light-emitting element is switched ON/OFF so as to be pulse-lighted, thus carrying out the PWM operation to thereby allow for more certain detection of the operating state of the patch density detecting section 80. FIGS. 5A to 5D are views of characteristic waveform showing a relation among a PWM control signal, ON-OFF wave pulse, and a voltage value of DC voltage. In FIGS. 5A to 5D, reference symbols A to D indicate as follows. FIG. 5A shows a PWM control signal. FIG. 5B shows an ON-OFF wave pulse obtained when the patch density detecting section 80 operates properly. The ON-OFF wave pulse corresponds to the PWM control signal. FIG. 5C shows an ON-OFF wave pulse obtained when the patch density detecting section 80 has lower sensitivity due to a toner attached to a surface of the emitting element and/or receiving element. In this case, the voltage value is around a quarter to one third of that in the normal condition. FIG. 5D shows a case where no patch density detection is carried out by the patch density detecting section 80 due to burnout etc. arisen inside the patch density detecting section 80. No ON-OFF wave pulse is thus detected. The operation detecting section disposed inside the sub central processing unit 201 detects the ON-OFF wave pulse shown in FIG. 5B to FIG. 5D, thereby allowing to certainly detect the operating state of the patch density detecting section 80.

In the embodiment, when a result detected by the operation detecting section indicates that the patch density detecting section 80 does not properly operate, a control is performed in which the patch forming section and the patch printing section are utilized. At the same time, the control may be carried out by utilizing the mark imparting section, the memory 202 referred to also as a memory section, the operation panel board 100 referred to also as a display section, and the first condition setting section. The patch forming section fabricates on the photoreceptor drum 43 toner patches which are sequentially different in toner density, as described above. The patch printing section controls the image forming section 32 so as to form patch images by printing on a recording medium the toner patches fabricated by the patch forming section. The patch images are, for example, visually checked by a user, and a patch image having the most favorable image density is thus selected. And the forming condition used for forming the toner patch corresponding to the above patch image is utilized also in the next image formation. For example, in the case of fixing the exposure potential and the charge potential at certain values while modifying the development bias voltage, a variation width of the development bias voltage is determined in advance, and a plurality of the development bias voltage values are set, thereby fabricating the toner patches corresponding to the respective values. And the development bias voltage value used in fabricating the toner patch corresponding to the patch image having the most favorable image density is inputted into the memory 202. On the basis of the development bias voltage value, the next image formation is carried out. The patch forming section fabricates toner patches with a plurality of the development bias voltage values which are set based on the development bias voltage values being inputted in the memory 202 and the fixed variation width being set, then conducting the same process as described above.

For selecting the conditions for forming the toner patch corresponding to the patch image having the most favorable image density, it is advantageous to use the mark imparting section, the memory 202 referred to also as a memory section, the operation panel board 100 referred to also as a display section, and the first condition setting section. The mark imparting section and the first condition setting section are function parts operated in the sub central processing unit 201 of the machine control board 200. The mark imparting section controls the toner patch printing section and thus the image forming section 32 so that different marks are imparted to respective patch images which are obtained in a manner that a plurality of the toner patches formed by the patch forming section are printed on a recording medium by the toner patch printing section. The conditions for forming a plurality of the toner patches are related to the marks which are attached to the patch images by the mark imparting section, and thus written as a data table into the memory 202. The data table is sent to the sub central processing unit 101 of the operation panel board 100 and written also into the memory 102. The sub central processing unit 101 of the operation panel board 100 causes the marks attached to the patch images, to be selectively displaced on the liquid crystal display 104 of the operation panel 103 based on the data table written in the memory 102. A user visually checks the plurality of the patch images and selects on the liquid crystal display 104 the mark imparted to the patch image having the optimum image density. Information of such selection is transmitted to the sub central processing unit 201 of the machine control board 200 via the sub central processing unit 101. The first condition setting section reads out from the memory 202 the forming conditions (for example, the development bias voltage value) corresponding to the selected mark, and inputs the forming conditions back into the memory 202 as the forming conditions which are to be used in the next image formation. The forming conditions inputted into the memory 202 are utilized as a reference value for next formation of toner patch. A configuration just described allows substantially automatic setting of the optimum image forming conditions, thereby enabling a drastic cut in a temporary down time of the image forming operation.

Further, the use of the image density detecting section 81 for detecting image density of the patch image can further shorten the temporary down time of the image forming operation. In this case, together with the image density detecting section 81, used are the mark imparting section, the image density determining section, the memory 202 referred to also as the memory section, and a second condition setting section. The image density detecting section 81 detects image densities of a plurality of the patch images which are printed on a recording medium by the patch printing section. A usable example of the image density detecting section 81 is a photoelectric sensor. The image density detecting section 81 is disposed, for example, on the side surface of image forming apparatus 1 provided with the catch tray 65, and is positioned above the catch tray 65 when viewed in the vertical direction so that the image density detecting section 81 can detect the image density of the patch image on the recording medium placed on the catch tray 65. A result detected by the image density detecting section 81 is sent to the sub central processing unit 201 of the machine control board 200, and written into the memory 202. At the time, the image density and the forming conditions for respective toner patches are written into the memory 202 in an order corresponding to the fixed order that the patch images are detected by the image density detecting section 81. The image density determining section compares the result detected by the image density detecting section 81 with the reference image density value which is written into the memory 202 in advances thereby determining a patch image whose image density value is equal to or the closest to the reference image density value. In response to the result detected by the image density determining section 81, the second condition setting section reads out from the memory 202 the conditions for forming the patch image having the proper image density value (which is equal to or the closest to the reference image density value), and inputs the conditions back into the memory 202 as the forming conditions which are to be used in the next image formation. A configuration just described allows automatic setting of the optimum image forming conditions, thereby enabling a further decrease in a temporary down time of the image forming operation.

Note that although a sensor is used for the image density detecting section 81 in the present embodiment, a device usable for detecting the image density is not limited to the above-stated sensor, and a document reader including a scanner may be used to detect the image density of the patch image.

Figure 6:
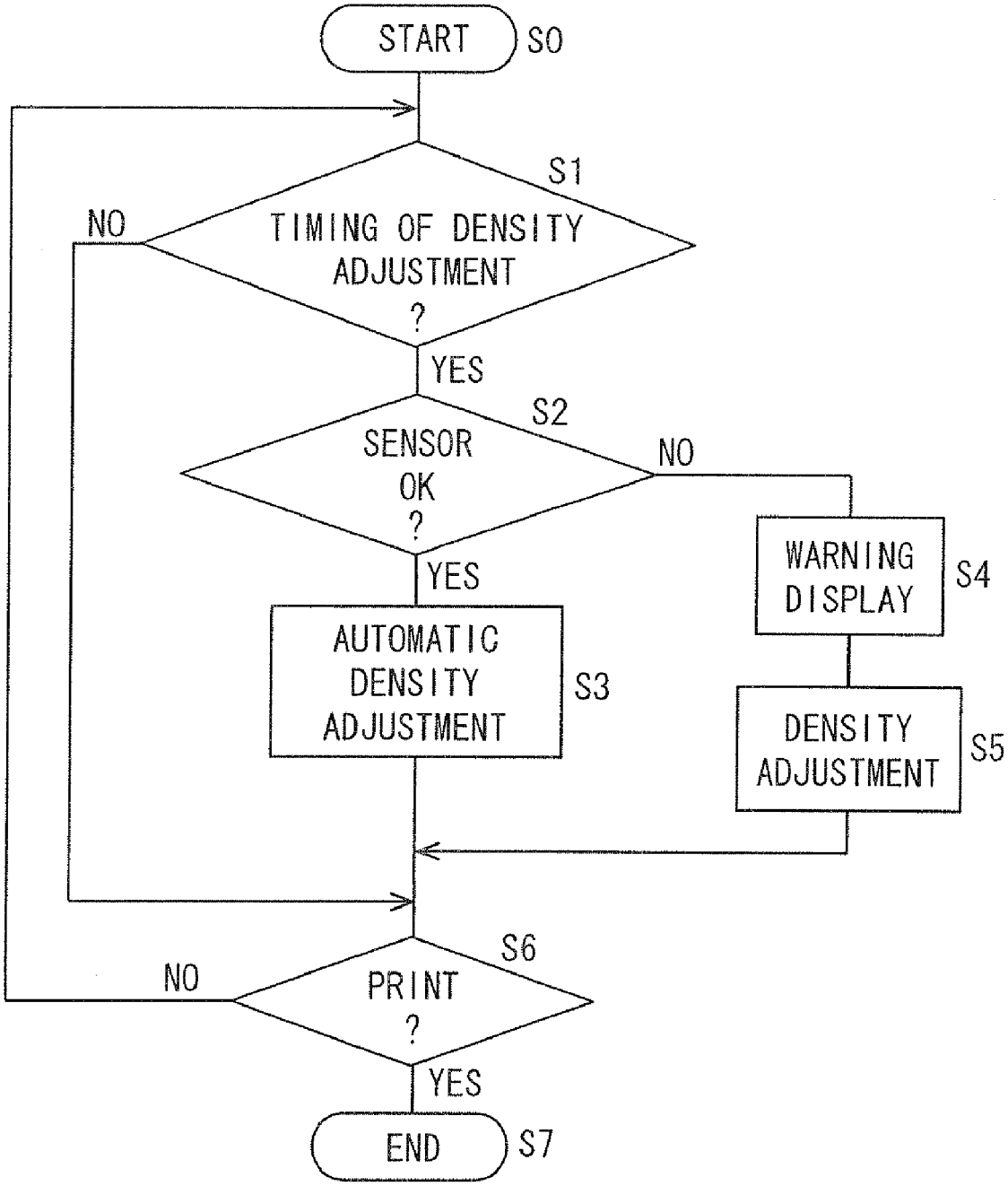
FIG. 6 is a flowchart for assisting explanation of a toner density adjusting operation in an image forming apparatus of an embodiment of the invention.

FIG. 6 is a flowchart for assisting explanation of a toner density adjusting operation in the image forming apparatus 1. At Step S0, a power source of the image forming apparatus 1 is turned on, thereby activating the image forming apparatus 1. At Step S1, in response to the input of a print command to the image forming apparatus 1, the sub central processing unit 201 determines whether or not the present time falls on a period (timing of toner density adjustment) for performing a toner density adjustment (process control). When the present time falls on the period for performing the toner density adjustment, the process proceeds to Step S2, and when the present time does not fall on the period, the process proceeds to Step S6. Examples of the period for performing the toner density adjustment are time points of power activation, when the temperature of the fixing portion 48 is equal to or lower than 45° C. in a non-standby state, when the number of printed sheet reaches 1,000 after previous high-density correction, when the toner density adjustment corresponding to humidity change is performed, upon replacing the photoreceptor drum, and upon replacing the developer. At Step S2, the operation detecting section detects whether or not the photoelectric sensor acting as the patch density detecting section 80 used in the process control operates properly and sends electric signals having the same voltage value to the sub central processing unit 201 at regular intervals. When the photoelectric sensor operates properly, the process proceeds to Step S3. When the photoelectric sensor does not properly operate, the process proceeds to Step S4. At Step S3, the process control is carried out, and the process then proceeds to Step S6. At Step S4, a warning that the patch density detecting section 80 does not properly operate is displayed on the liquid crystal display 104 to inform the user, and the process then proceeds to Step S4. At Step S5, the density adjustment according to an embodiment of the invention is carried out, and the process then proceeds to Step S6. At Step S6, the printing operation is carried out, and when the image density of the printed image is proper, the printing operation is terminated and the process thus reaches an end S7. When the image density is not proper, the process returns to Step S1 and the following steps are then repeated.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. An image forming apparatus, comprising:

an image forming section haying at least an image bearing member on which surface an electrostatic latent image is formed, the image forming section being used for printing an image by supplying a toner to the electrostatic latent image on the image bearing member to form a toner image and transferring and fixing the toner image onto a recording medium;

a patch forming section structured to control the image forming section so as to form on the image bearing member a plurality of toner patches whose toner densities are different from each other in sequence, by changing toner patches forming conditions;

a patch density detecting section structured to detect patch densities which are the toner densities of the plurality of the toner patches formed on the image bearing member;

a toner density adjusting section structured to adjust a density of the toner image formed by the image forming section, depending on the patch densities detected by the patch density detecting section;

an operation detecting section structured to detect whether or not the patch density detecting section is operating properly; and a patch printing section structured to control the image forming section, when the operation detecting section detects that the patch density detecting section is not operating properly, so as to form a plurality of patch images by printing on the recording medium the plurality of the toner patches which are formed on the image bearing member and different in density from each other in sequence.

2. The image forming apparatus of claim 1, further comprising:

a mark imparting section structured to control the patch printing section, when the operation detecting section detects that the patch density detecting section is not operating properly, so as to impart different marks to patch images corresponding to the plurality of the toner patches formed by the patch forming section;

a memory section structured to record therein forming conditions of the plurality of the toner patches formed by the patch forming section, so as to correspond to the marks imparted by the mark imparting section to the patch images;

a display section structured to selectively display marks corresponding to the marks imparted by the mark imparting section to the patch images; and a condition setting section structured to read out from the memory section the forming conditions corresponding to the mark selected by the display section, and to set the forming conditions as toner image forming conditions.

3. The image forming apparatus of claim 1, further comprising:

an image density detecting section structured to detect image densities of the plurality of the patch images printed on the recording medium by the patch printing section;

an image density determining section structured to determine a patch image having proper image density, depending on the image densities detected by the image density detecting section;

a memory section structured to record therein forming conditions of the plurality of the toner patches formed on the image bearing member by the patch forming section; and a condition setting section structured to read out from the memory section the forming conditions of the toner patch corresponding to the patch image having the proper image density determined by the image density determining section, and to set the forming conditions as toner image forming conditions.

4. The image forming apparatus of claim 1, wherein the forming conditions of the toner patches include one or more of a development bias voltage value, a charging voltage value of the image bearing member, and a charging voltage value of the electrostatic latent image.

5. The image forming apparatus of claim 1, wherein the patch density detecting section comprises:

a light-emitting element structured to emit light to the toner patch; and a light-receiving element structured to detect a reflection light amount of the light emitted from the light-emitting element to the toner patch, and to output an electric signal converted from the detected reflection light amount.

6. The image forming apparatus of claim 5, further comprising a light emission control section structured to control the light-emitting element to be switched on and off, wherein the operation detecting section detects whether or not the patch density detecting section is operating properly, based on switch-on and-off of the light-emitting element conducted by the light emission control section.

7. The image forming apparatus of claim 6, wherein the light emission control section controls the light-emitting element to be switched on and off so as to pulse-light the light-emitting element.

8. The image forming apparatus of claim 6, further comprising:

a control unit structured to receive as input the electric signal from the light-receiving element of the patch density detecting section; and a capacitor through which the electric signal from the light-receiving element of the patch density detecting section is inputted to the control unit.

9. The image forming apparatus of claim 1, wherein the image bearing member is a photoreceptor drum.

10. A process control method of setting image forming conditions of an image forming apparatus, the method comprising:

forming, using an image forming section, a plurality of patch images on a recording medium by transferring a plurality of toner patches from a photoreceptor drum to a recording medium, each patch image having a different toner density (image density) from other patch images;

detecting, using a sensor unit, the image densities of the plurality of patch images formed on the recording medium;

selecting, using a control unit, the patch image on the recording medium whose image density is closest to a reference image density;

setting, using the control unit, the image forming conditions corresponding to the selected patch image for subsequent image forming;

detecting, using the sensor unit, a toner density of a toner image formed on the photoreceptor drum (drum toner density); and determining, using the control unit, whether the sensor unit is properly detecting the drum toner density, wherein the step of forming the plurality of patch images on the recording medium is performed when it is determined that the sensor unit is not properly detecting the drum toner density.

11. The process control method of claim 10, wherein the step of detecting the drum toner density comprises:

emitting, using a light-emitting element, light to the toner image on the photoreceptor drum; and detecting, using a light-receiving element, an amount of light reflected from the toner image.

12. The process control method of claim 11, wherein the step of detecting the drum toner density further comprises outputting, using the light-receiving element, an electrical signal corresponding to the amount of reflected light, and wherein the step of determining whether the sensor unit is properly detecting the drum toner density comprises detecting whether the electrical signal is being outputted by the light-receiving element.

13. The process control method of claim 11, wherein the step of emitting the light to the toner image on the photoreceptor drum comprises emitting, using the light-emitting element, pulse-width modulated light, and wherein the step of determining whether the sensor unit is properly detecting the drum toner density comprises detecting whether electrical signal pulses are being outputted by the light-receiving element.

* * * * *